US011170961B2

(12) United States Patent
Minowa et al.

(10) Patent No.: US 11,170,961 B2
(45) Date of Patent: Nov. 9, 2021

(54) RELAY

(71) Applicant: Omron Corporation, Kyoto (JP)

(72) Inventors: Ryota Minowa, Kumamoto (JP); Hiroyuki Iwasaka, Kumamoto (JP); Yasuo Hayashida, Kumamoto (JP); Shingo Mori, Kumamoto (JP)

(73) Assignee: Omron Corporation, Kyoto (JP)

( * ) Notice: Subject to any disclaimer, the term of this patent is extended or adjusted under 35 U.S.C. 154(b) by 125 days.

(21) Appl. No.: 16/282,354

(22) Filed: Feb. 22, 2019

(65) Prior Publication Data

US 2019/0304728 A1 Oct. 3, 2019

(30) Foreign Application Priority Data

Mar. 30, 2018 (JP) ..... JP2018-068873

(51) Int. Cl.
*H01H 50/58* (2006.01)
*H01H 50/04* (2006.01)
*H01H 50/76* (2006.01)

(52) U.S. Cl.
CPC ..... *H01H 50/58* (2013.01); *H01H 50/04* (2013.01); *H01H 50/76* (2013.01)

(58) Field of Classification Search
CPC ..... H01H 50/04
USPC ..... 335/126, 131, 185
See application file for complete search history.

(56) References Cited

U.S. PATENT DOCUMENTS 4,013,984 A * 3/1977 Wafer ..... H01H 9/36 335/185
6,880,226 B2 * 4/2005 McGill ..... H01H 50/546 200/16 A
7,034,643 B1 * 4/2006 Kusumoto ..... F02N 15/067 335/126
7,859,373 B2 * 12/2010 Yamamoto ..... H01H 50/305 335/126

(Continued)

FOREIGN PATENT DOCUMENTS

CN 104779119 A 7/2015
CN 206163426 U 5/2017

(Continued)

OTHER PUBLICATIONS

Office Action issued in Chinese Application No. 201910109744.X; dated Nov. 12, 2020 (18 pages).

(Continued)

*Primary Examiner* — Alexander Talpalatski
(74) *Attorney, Agent, or Firm* — Osha Bergman Watanabe & Burton LLP

(57) ABSTRACT

A relay has a first fixed contact, a second fixed contact, a movable touch piece including a first movable contact that is disposed facing the first fixed contact, and a second movable contact that is disposed facing the second fixed contact, the movable touch piece being disposed so as to be movable in a contact direction in which the first movable contact and the second movable contact come into contact with the first fixed contact and the second fixed contact and a separation direction in which the first movable contact and the second movable contact separate from the first fixed contact and the second fixed contact, and a drive device disposed in the contact direction with respect to the movable touch piece and configured to generate a driving force for moving the movable touch piece.

18 Claims, 8 Drawing Sheets

(56) References Cited

U.S. PATENT DOCUMENTS

| | | | | |
|---|---|---|---|---|
| 7,911,301 | B2 * | 3/2011 | Yano | H01H 50/443 335/131 |
| 8,390,408 | B2 * | 3/2013 | Nawa | H01H 3/001 335/131 |
| 8,803,642 | B2 * | 8/2014 | Imamura | H01H 33/04 335/201 |
| 8,941,453 | B2 * | 1/2015 | Yano | H01H 50/54 335/131 |
| 9,412,545 | B2 * | 8/2016 | Kubono | H01H 50/18 |
| 9,865,419 | B2 * | 1/2018 | Blackmon | H01H 9/043 |
| 2009/0066450 | A1 | 3/2009 | Yano et al. | |
| 2012/0092094 | A1 * | 4/2012 | Lee | H01H 51/065 335/78 |
| 2015/0022292 | A1 * | 1/2015 | Tachikawa | H01H 49/00 335/131 |
| 2015/0213984 | A1 | 7/2015 | Naka et al. | |

FOREIGN PATENT DOCUMENTS

| | | | |
|---|---|---|---|
| CN | 207068750 | U | 3/2018 |
| JP | 3885408 | B2 | 2/2007 |
| JP | 2007-305467 | A | 11/2007 |
| JP | 2014-099373 | A | 5/2014 |
| JP | 2017-097979 | A | 6/2017 |

OTHER PUBLICATIONS

Office Action in counterpart Chinese Patent Application No. 201910109744.X dated Mar. 17, 2021 (13 pages).

* cited by examiner

RELAY

CROSS-REFERENCE TO RELATED APPLICATION

This application claims priority to Japanese Patent Application No. 2018-068873 filed with the Japan Patent Office on Mar. 30, 2018, the entire contents of which are incorporated herein by reference.

BACKGROUND

Field

The present invention relates to a relay.

Related Art

A relay is provided with a movable touch piece including a movable contact, and a fixed terminal including a fixed contact. The movable touch piece is connected to a drive shaft. The drive shaft is driven by a drive device such as a coil. Thereby, the movable touch piece operates and the movable contact comes in contact with or separates from the fixed contact so that the contacts are opened and closed.

For example, in Japanese Unexamined Patent Publication No. 2014-99373, a movable touch piece and a fixed terminal are housed in a case. A drive shaft protrudes from the case toward a drive device, and the drive shaft is pulled toward the drive device by the drive device, thereby bringing a movable contact into contact with a fixed contact.

SUMMARY

At the time of assembling the relay, it is necessary to confirm characteristics of the relay such as a stroke amount of the movable touch piece. However, in Japanese Unexamined Patent Publication No. 2014-99373, since the movable touch piece is stored in the case, it is not easy to access the movable touch piece. In addition, when the case is opened and a characteristic test is conducted, there is a possibility that foreign matter may enter and adhere to the contacts. In that instance, contact failure of the contact may occur.

Meanwhile, with the drive shaft protruding from the case to the drive device side, by pulling the drive shaft from the drive device side, the movable touch piece can be moved. However, in this instance, a latching portion for pulling the drive shaft needs to be provided on the drive shaft. This makes the structure complicated. In addition, it is difficult to accurately set the characteristics.

One or more embodiments of the present invention provides a relay capable of easily confirming characteristics while preventing occurrence of contact failure of contacts.

A relay according to one aspect includes a first fixed contact, a second fixed contact, a movable touch piece, a drive device, a drive shaft, and a first case. The movable touch piece includes a first movable contact and a second movable contact. The first movable contact is disposed facing the first fixed contact. The second movable contact is disposed facing the second fixed contact. The movable touch piece is disposed movably in a contact direction and a separation direction. The contact direction is a direction in which the first movable contact and the second movable contact come into contact with the first fixed contact and the second fixed contact. The separation direction is a direction in which the first movable contact and the second movable contact separate from the first fixed contact and the second fixed contact.

The drive device is disposed in the contact direction with respect to the movable touch piece. The drive device generates a driving force for moving the movable touch piece. The drive shaft extends in the movement direction of the movable touch piece. The drive shaft includes an end portion protruding in a separation direction from the movable touch piece. The drive shaft transmits the driving force to the movable touch piece. The first case accommodates a first fixed contact, a second fixed contact, and the movable touch piece. The first case includes a test hole penetrating the first case. The test hole is disposed at a position facing the end portion of the drive shaft in the separation direction.

In the relay according to the present aspect, a drive device is disposed in a contact direction with respect to a movable touch piece. In addition, in the first case, a test hole is provided at a position facing the end portion of the drive shaft in the separation direction. Therefore, while the first case is attached to the relay, it is possible to easily access the drive shaft from the opposite side of the drive device through the test hole. For example, by inserting a jig into the test hole and pushing the drive shaft, the characteristics such as the stroke of the movable touch piece can be easily confirmed. Hence it is possible to easily confirm the characteristics while preventing the occurrence of contact failure of the contacts.

A spring for biasing the movable touch piece in the separation direction may be further included. In this instance, by accessing to the drive shaft through the test hole, it is possible to easily confirm the characteristics such as the urging force of the spring.

The relay may further include a second case that covers the first case. In this instance, the hermeticity inside the relay can be improved by the second case.

The second case may include a closing portion that closes the test hole. In this instance, by closing the test hole by the closing portion, the hermeticity inside the relay can be improved.

The closing portion may be a protrusion protruding from the inner surface of the second case. In this instance, by covering the second case with the first case, the test hole can be easily closed by the closing portion.

The protrusion may include a guide hole into which the drive shaft is inserted. In this instance, the projection for closing the test hole can also serve as a guide for preventing the inclination of the drive shaft.

The relay may further include an elastic member disposed between the second case and the first case. The elastic member may close the test hole. In this instance, the test hole can be closed by the elastic member in a normal state. Further, when pressure inside the first case increases due to an arc generated at the time of turning on and off the load, the pressure can be released from the test hole to the outside through the gap between the elastic member and the first case.

The elastic member may have a sheet shape. In this instance, it is possible to adjust the closing of the test hole and the release of the pressure to the outside by the sheet-shaped elastic member.

The drive shaft may be inserted into the test hole. In this instance, the test hole can also serve as a guide for preventing the inclination of the drive shaft.

The first case may include a tubular guide portion extending in the axial direction of the drive shaft. The test hole may penetrate the guide portion. In this instance, the inclination of the drive shaft can be prevented by the guide portion.

According to one or more embodiments of the present invention, it is possible to easily confirm characteristics in a relay while preventing occurrence of contact failure of contacts.

DETAILED DESCRIPTION

Figure 1:
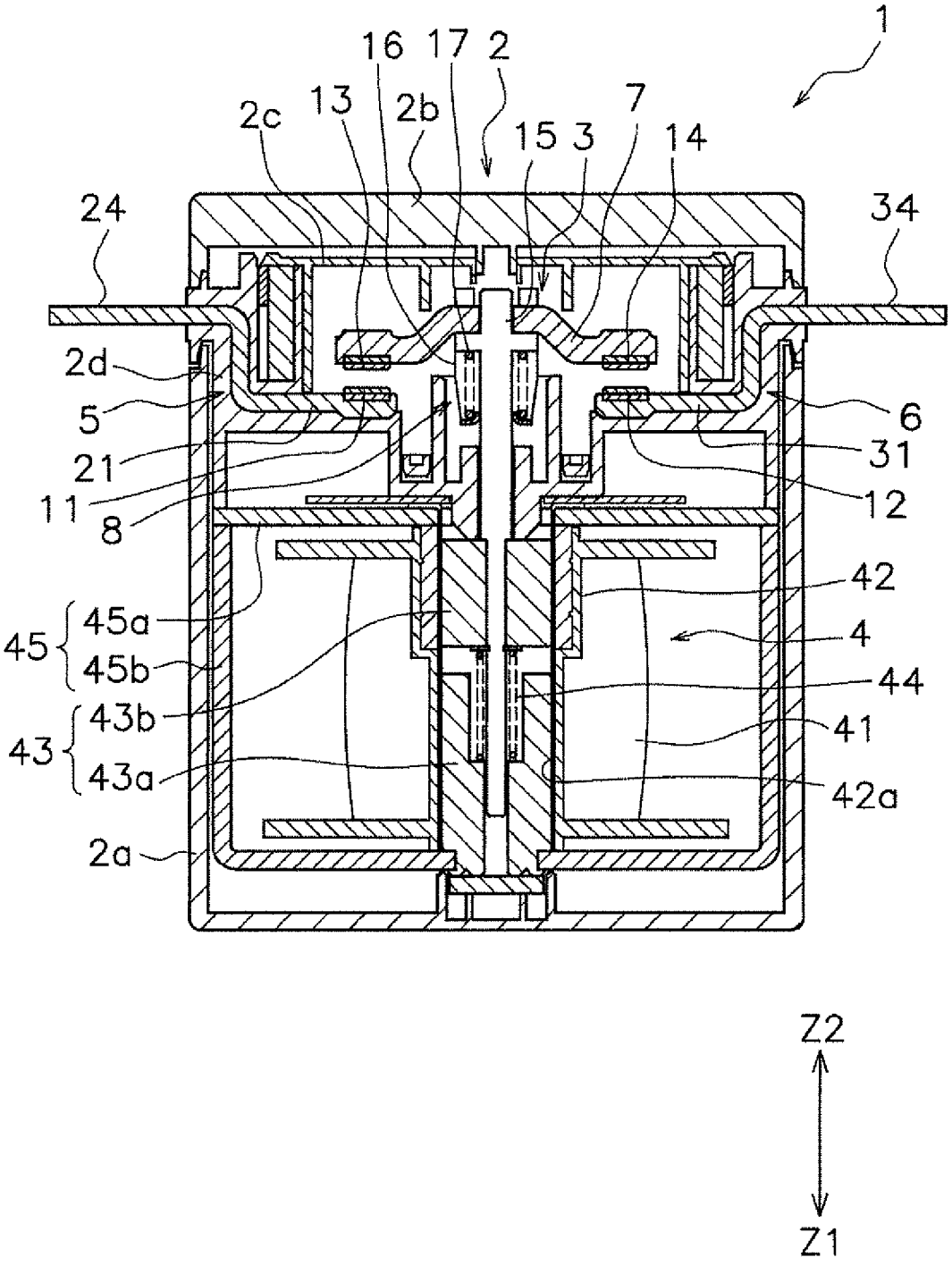
FIG. 1 is a sectional view of a relay according to one or more embodiments of the present invention.

Hereinafter, Embodiments of the present invention will be described with reference to the drawings. FIG. 1 is a sectional view illustrating a relay 1 according to an embodiment. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. As illustrated in FIG. 1, the relay 1 includes a case 2, a contact device 3, and a drive device 4.

The case 2 accommodates the contact device 3 and the drive device 4. The case 2 is formed of a resin having insulation. The contact device 3 and the drive device 4 are disposed in the case 2.

The contact device 3 includes a first fixed terminal 5, a second fixed terminal 6, a movable touch piece 7, and a touch piece holding portion 8. The first fixed terminal 5, the second fixed terminal 6, and the movable touch piece 7 are formed of a material having conductivity. The first fixed terminal 5 includes a first fixed contact 11. The second fixed terminal 6 includes a second fixed contact 12. The first fixed contact 11 and the second fixed contact 12 are disposed apart from each other in a longitudinal direction of the movable touch piece 7 (a right-left direction in FIG. 1).

The movable touch piece 7 includes a first movable contact 13 and a second movable contact 14. The first movable contact 13 is disposed facing the first fixed contact 11. The second movable contact 14 is disposed facing the second fixed contact 12. The movable touch piece 7 is disposed movably in a contact direction Z1 and a separation direction Z2.

The contact direction 21 is a direction (downward in FIG. 1) in which the first movable contact 13 and the second movable contact 14 come into contact with the first fixed contact 11 and the second fixed contact 12. The separation direction Z2 is a direction (upward in FIG. 1) in which the first movable contact 13 and the second movable contact 14 separate from the first fixed contact 11 and the second fixed contact 12.

The touch piece holding portion 8 holds the movable touch piece 7. The touch piece holding portion 8 includes a drive shaft 15, a holder 16, and a contact spring 17. The drive shaft 15 extends in a movement direction (21, 22) of the movable touch piece 7. The drive shaft 15 is disposed movably in the contact direction Z1 and the separation direction 22. The holder 16 is connected to the movable touch piece 7 and holds the movable touch piece 7. The contact spring 17 is disposed between the drive shaft 15 and the holder 16. The drive shaft 15 is connected to the holder 16 via a contact spring 17. The structure of the touch piece holding portion 8 will be described later in detail.

The first fixed terminal 5 includes a first contact support 21 and a first external connection 24. The first contact support 21 supports the first fixed contact 11 in the case 2. The first external connection 24 is connected to the first contact support 21. The first external connection 24 protrudes outward of the case 2. The first external connection 24 may be formed integrally with the first contact support 21. Alternatively, the first external connection 24 may be separate from the first contact support 21.

The second fixed terminal 6 includes a second contact support 31 and a second external connection 34. The second contact support 31 supports the second fixed contact 12 inside the case 2. The second external connection 34 is connected to the second contact support 31. The second external connection 34 protrudes outward of the case 2. The second external connection 34 may be formed integrally with the second contact support 31. Alternatively, the second external connection 34 may be separate from the second contact support 31.

The drive device 4 generates a driving force for operating the movable touch piece 7. The drive device 4 operates the movable touch piece 7 by an electromagnetic force. The drive device 4 is disposed in the contact direction Z1 with respect to the movable touch piece 7. The drive device 4 includes a coil 41, a spool 42, a core 43, a return spring 44, and a yoke 45.

The coil 41 is wound around the spool 42. The coil 41 and the spool 42 are disposed coaxially with the drive shaft 15. The spool 42 includes a hole 42*a* penetrating in an axial direction of the spool 42. The iron core 43 and the return spring 44 are inserted into a hole 42*a* of the spool 42. The yoke 45 is connected to the iron core 43.

The yoke 45 includes a first yoke 45*a* and a second yoke 45*b*. The first yoke 45*a* is disposed between the contact device 3 and the spool 42. The second yoke 45*b* is connected to the first yoke 45*a*. The second yoke 45*b* includes a U-shape. The second yoke 45*b* is disposed on each side of the coil 41 and on the side opposite to the first yoke 45*a* with respect to the coil 41. The first yoke 45*a* is connected to one end of the iron core 43. The second yoke 45*b* is connected to the other end of the iron core 43.

The iron core 43 includes a fixed iron core 43*a* and a movable iron core 43*b*. The fixed iron core 43*a* is fixed to the second yoke 45*b*. The movable iron core 43*b* is separate from the fixed iron core 43*a*. The movable iron core 43*b* is disposed movably in the contact direction Z1 and the separation direction Z2. The movable iron core 43*b* is connected to the drive shaft 15. The return spring 44 is disposed between the movable iron core 43*b* and the fixed iron core 43*a*. The return spring 44 urges the movable iron core 43*b* in the separation direction Z2.

Figure 2:
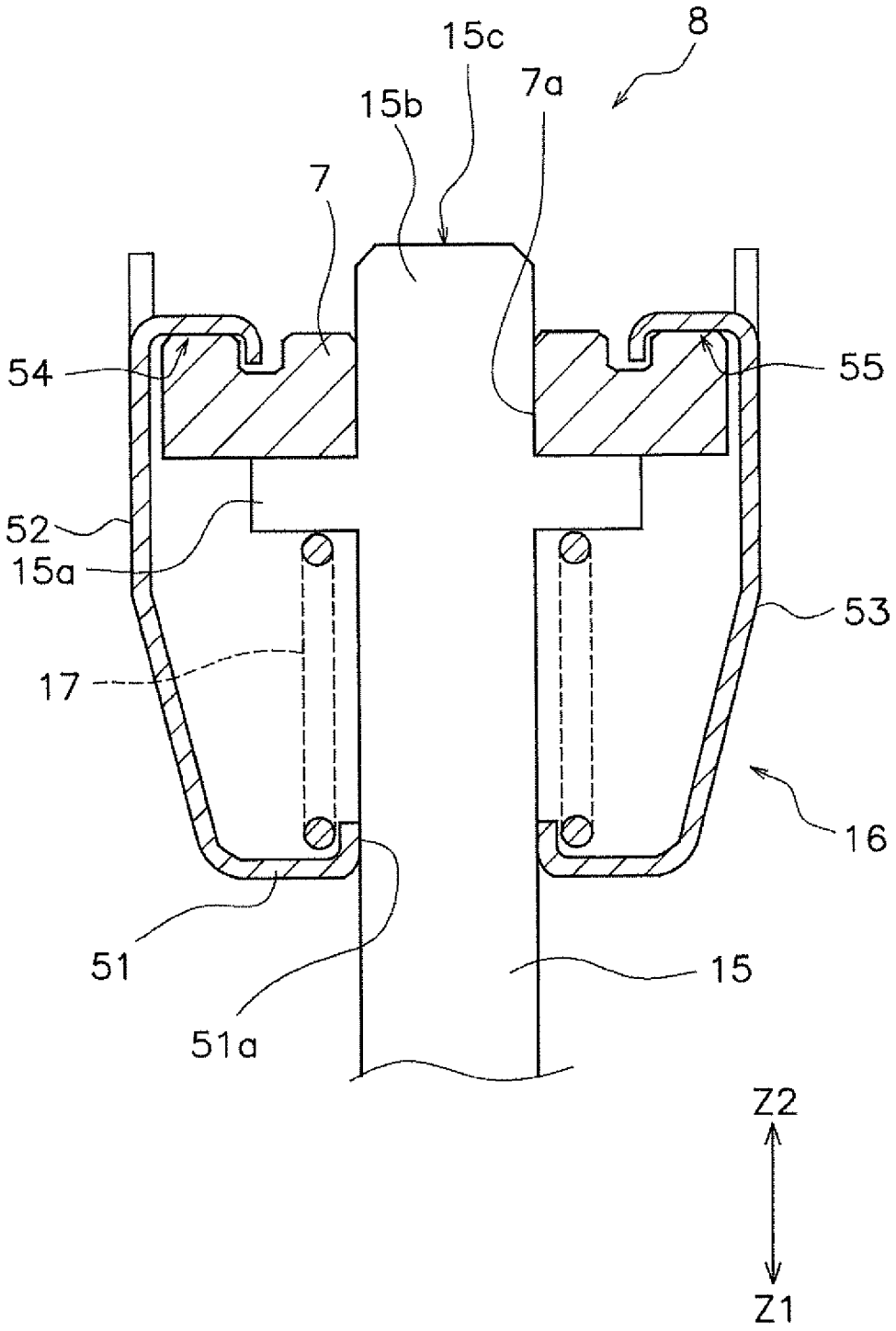
FIG. 2 is a sectional view of a touch piece holding portion.

Next, the touch piece holding portion 8 will be described in detail. FIG. 2 is a sectional view of the touch piece holding portion 8. As illustrated in FIG. 2, the drive shaft 15 includes a flange portion 15*a* protruding in the radial direction. The flange portion 15*a* is disposed in the contact direction Z1 with respect to the movable touch piece 7. The drive shaft 15 includes a guide shaft portion 15*b* protruding in the separation direction Z2 from the flange portion 15*a*. The guide shaft portion 15*b* is inserted into a hole 7*a* provided in the movable touch piece 7. The guide shaft portion 15*b* is disposed so as to be movable in the axial direction of the drive shaft 15 with respect to the movable touch piece 7. The guide shaft portion 15*b* includes an end portion 15*c* protruding in the separation direction Z2 from the movable touch piece 7.

The holder 16 includes a base 51, a first side surface 52, a second side surface 53, a first pressing surface 54, and a second pressing surface 55. The base 51 is disposed facing the movable touch piece 7. The base 51 is provided with a hole 51*a* through which the drive shaft 15 is allowed to pass. The flange portion 15*a* is disposed between the movable touch piece 7 and the base 51 in the movement direction (Z1, Z2) of the movable touch piece 7. The contact spring 17 is disposed between the flange portion 15*a* and the base 51.

The first side surface 52 and the second side surface 53 extend from the base 51 toward the movable touch piece 7. A part of the drive shaft 15 and the contact spring 17 are disposed between the first side surface 52 and the second side surface 53.

The first pressing surface 54 extends from the first side surface 52 along the surface of the movable touch piece 7. The second pressing surface 55 extends from the second side surface 53 along the surface of the movable touch piece 7. The first pressing surface 54 and the second pressing surface 55 come into contact with the movable touch piece 7 to press the movable touch piece 7.

Figure 3A:
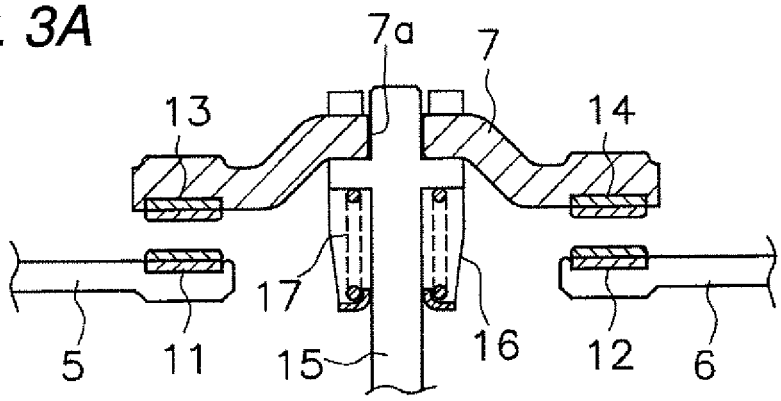
FIGS. 3A to 3C are diagrams illustrating opening and closing operations of contacts.

Next, the operation of the relay 1 will be described. When no voltage is applied to the coil 41, the drive shaft 15 is pressed, together with the movable iron core 43*b*, in the separation direction Z2 by an elastic force of the return spring 44. Therefore, the movable touch piece 7 is also pressed in the separation direction Z2, and as illustrated in FIG. 3A, the first movable contact 13 and the second movable contact 14 are in an open state, being separated from the first fixed contact 11 and the second fixed contact 12.

Note that the contact spring 17 is disposed between the flange portion 15*a* and the base 51 in a pre-compressed state. Therefore, in the open state illustrated in FIG. 3A, the contact spring 17 urges the holder 16 and the flange portion 15*a* in a direction sandwiching the movable touch piece 7. The first pressing surface 54 and the second pressing surface 55 of the holder 16 are thus kept in contact with the movable touch piece 7.

Figure 3B:
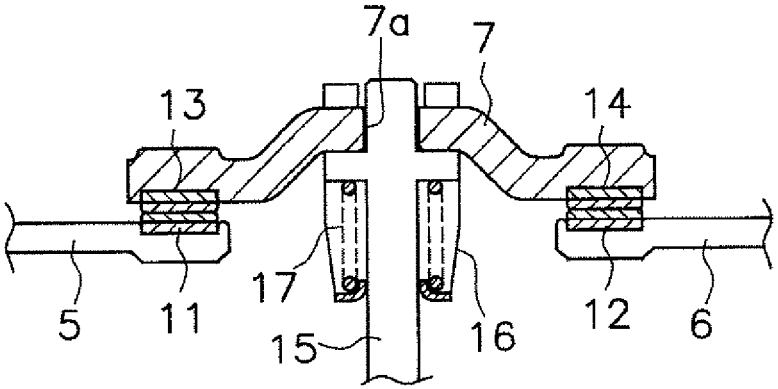

When a voltage is applied to the coil 41 and excited, by an electromagnetic force of the coil 41, the movable iron core 43*b* moves in the contact direction Z1 against the elastic force of the return spring 44. Thus, as illustrated in FIG. 3B, the drive shaft 15, the holder 16, and the movable touch piece 7 move together in the contact direction Z1, and the first movable contact 13 and the second movable contact 14 come into contact with the first fixed contact 11 and the second fixed contact 12.

Figure 3C:
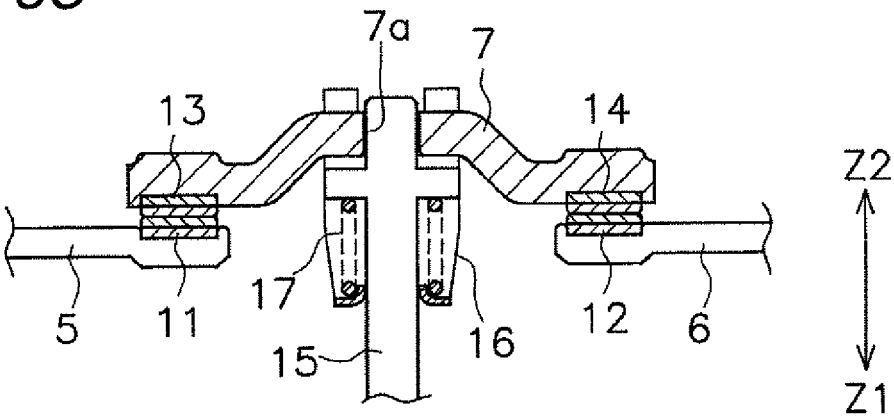

In this state, the movement of the movable touch piece 7 and the holder 16 in the contact direction Z1 is restricted by the first fixed terminal 5 and the second fixed terminal 6, but the drive shaft 15 is movable with respect to the movable touch piece 7. Therefore, when the movable iron core 43*b* further moves in the contact direction Z1 by the electromagnetic force of the coil 41, the drive shaft 15 further moves in the contact direction Z1. As a result, as illustrated in FIG. 3C, the contact spring 17 contracts due to being pushed by the flange portion 15*a*. In this state, the contact spring 17 urges the holder 16 in the contact direction Z1 by the elastic force. Then, the first pressing surface 54 and the second pressing surface 55 of the holder 16 come into contact with the movable touch piece 7 and press the movable touch piece 7 in the contact direction Z1.

Next, the structure of the case 2 will be described in detail. As illustrated in FIG. 1, the case 2 includes a first inner case 2*c* and a second inner case 2*d*. The first inner case 2*c* and the second inner case 2*d* accommodate the movable touch piece 7, the first fixed terminal 5, and the second fixed terminal 6. The first inner case 2*c* is attached to the second inner case 2*d* and covers the movable touch piece 7 from the separation direction Z2. The second inner case 2*d* covers the side of the movable touch piece 7. The second inner case 2*d* covers the movable touch piece 7 from the contact direction Z1. The second inner case 2*d* partitions the drive device 4 and the movable touch piece 7.

The case 2 includes a first outer case 2*a* and a second outer case 2*b*. The first outer case 2*a* and the second outer case 2*b* accommodate the first inner case 2*c* and the second inner case 2*d*. The second outer case 2*b* is attached to the first outer case 2*a* and covers the first inner case 2*c* from the separation direction Z2.

Figure 4:
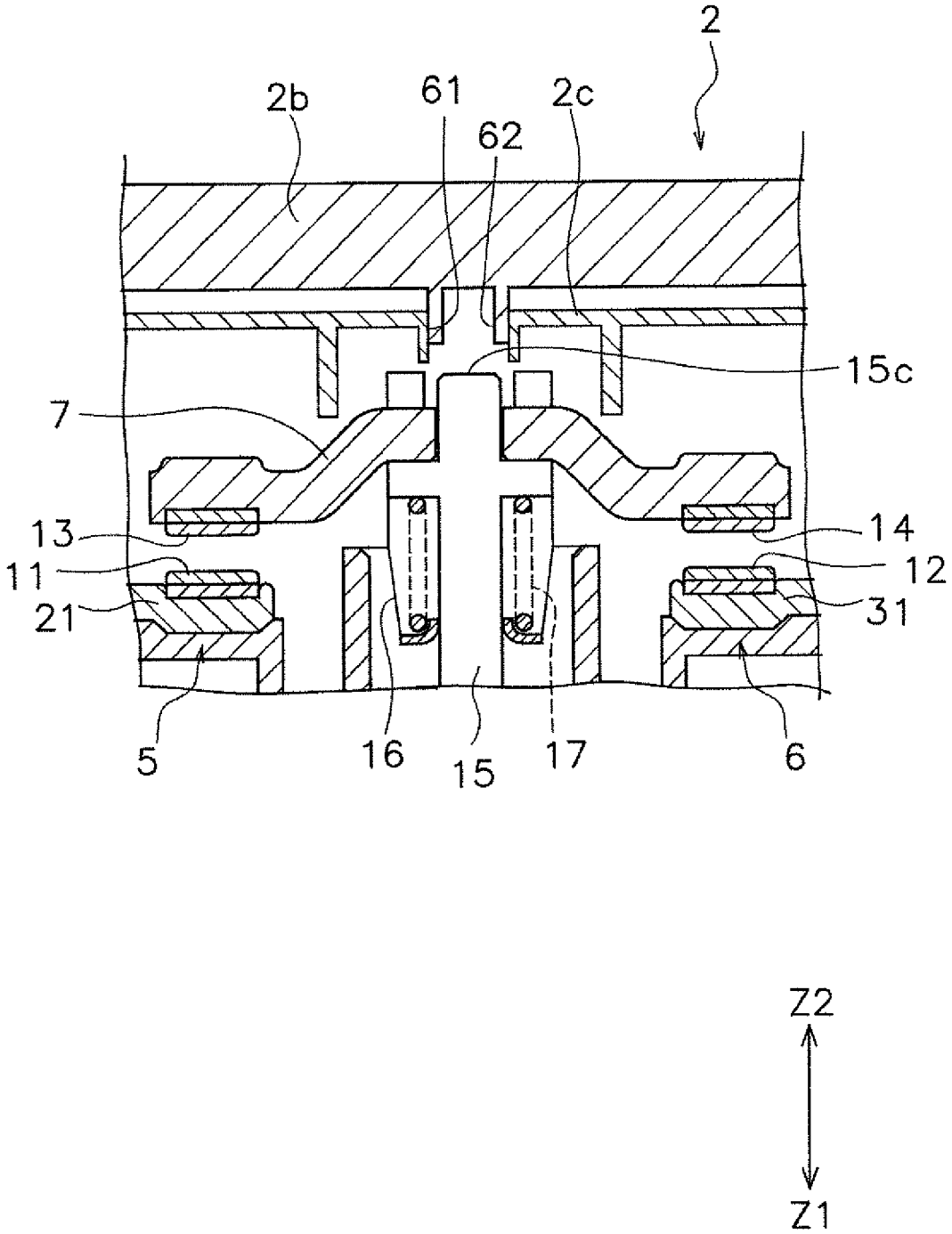
FIG. 4 is a sectional view of the periphery of the first inner cover and the second outer cover.

FIG. 4 is an enlarged sectional view of the periphery of the first inner case 2*c* and the second outer case 2*b*. As illustrated in FIG. 4, the first inner case 2*c* includes a test hole 61 penetrating the first inner case 2*c*. The test hole 61 penetrates in the movement direction (Z1, Z2) of the movable touch piece 7. The test hole 61 is disposed concentrically with the drive shaft 15. The test hole 61 is disposed at a position facing the end portion 15*c* of the drive shaft 15 in the separation direction Z2. The test hole 61 overlaps with the end portion 15*c* of the drive shaft 15 as viewed in the separation direction Z2. An inner diameter of the test hole 61 is larger than an outer diameter of the end portion 15*c* of the drive shaft 15. However, the inner diameter of the test hole 61 may be equal to or smaller than the outer diameter of the end portion 15*c*.

The second outer case 2*b* includes a closing portion 62. The closing portion 62 is a protrusion protruding from the inner surface of the second outer case 2*b*. The closing portion 62 protrudes in the contact direction Z1 from the inner surface of the second outer case 2*b*. While the second outer case 2*b* is attached to the first outer case 2*a*, the closing portion 62 is inserted into the test hole 61 and closes the test hole 61.

In the relay 1 according to one or more embodiments of the present invention, the drive device 4 is disposed in the contact direction Z1 with respect to the movable touch piece 7. In addition, the first inner case 2*c* is provided with the test hole 61 at a position facing the end portion 15*c* of the drive shaft 15 in the separation direction Z2.

Figure 5:
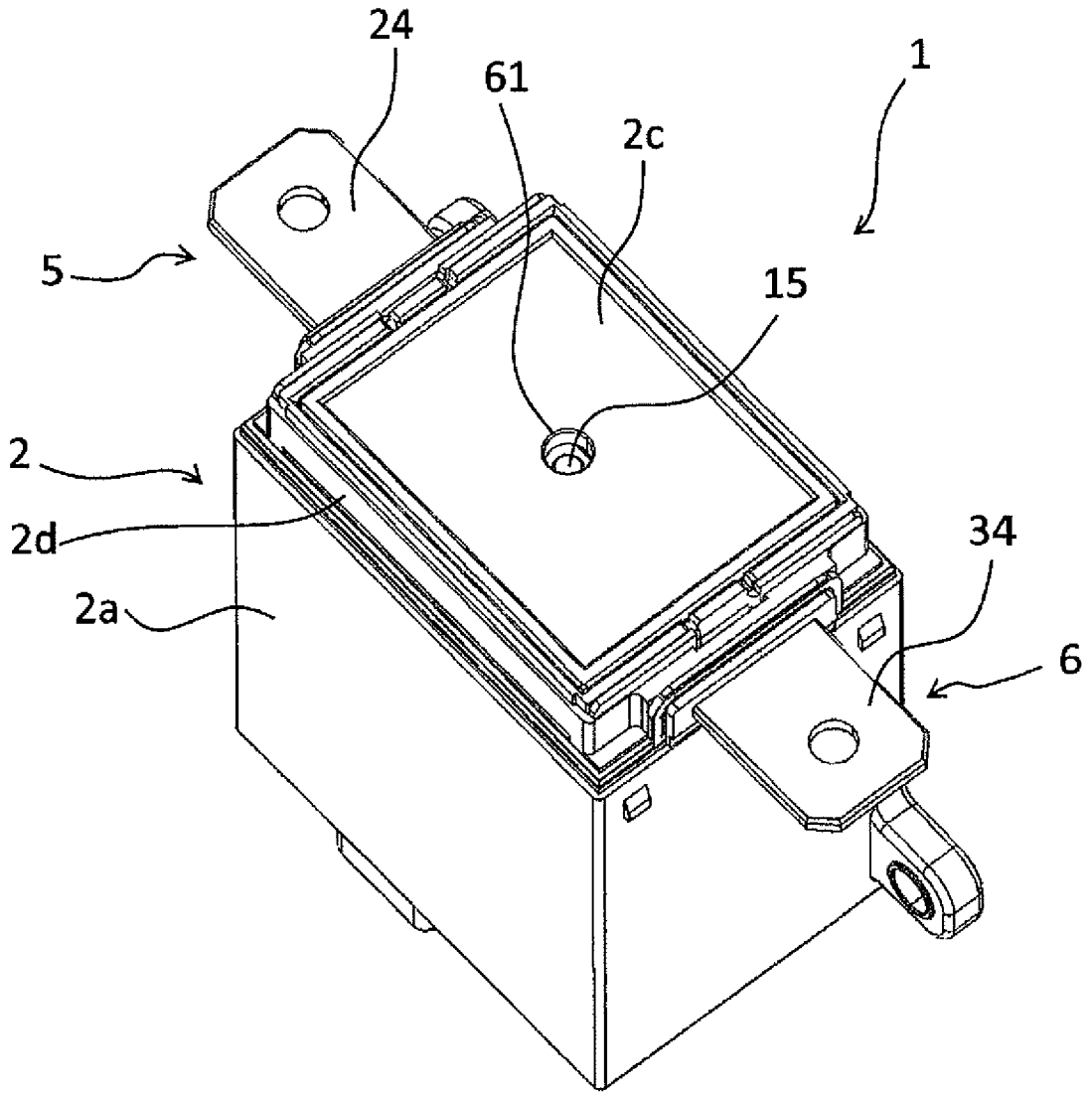
FIG. 5 is a perspective view of the relay in a state where the second outer cover is removed.

FIG. 5 is a perspective view illustrating the relay 1 with the second outer case 2*b* removed. As illustrated in FIG. 5, removing the second outer case 2*b* from the relay 1 enables easy access to the drive shaft 15 from the opposite side of the drive device 4 through the test hole 61 with the first inner case 2*c* being attached.

Thus, for example, by pressing the end portion 15*c* of the drive shaft 15 with a jig having a load cell, it is possible to measure the relationship between a stroke of the movable touch piece 7 and an elastic force of the return spring 44 or the contact spring 17. As a result, it is possible to easily confirm the characteristics of the relay 1 with the first inner case 2*c* being attached. It is thus possible to easily confirm the characteristics while preventing the occurrence of contact failure of the contacts due to entry of foreign matter.

The first inner case 2*c* and the second inner case 2*d* are accommodated in the first outer case 2*a* and the second outer case 2*b*. For this reason, even when the test hole 61 is provided in the first inner case 2*c*, the hermeticity inside the relay 1 can be improved.

The second outer case 2*b* includes a closing portion 62 that closes the test hole 61. It is thus possible to improve the hermeticity inside the relay 1 with the second outer case 2*b* being attached.

Although embodiments of the present invention are described above, the present invention is not limited to the above embodiments, and various changes can be made in the scope not deviating from the gist of the present invention. For example, the configuration of the drive device 4 may be changed. The shape or placement of the coil 41, the spool 42, the iron core 43, the return spring 44, or the yoke 45 may be changed. The shape or placement of the case 2 may be changed.

The shape or placement of the first fixed terminal 5, the second fixed terminal 6, and the movable touch piece 7 may be changed. For example, the placement of the first fixed terminal 5 and the second fixed terminal 6 is not limited to that of the embodiments described above, and may be interchanged. The shape or placement of the touch piece holding portion 8 may be changed. For example, the shape of the holder 16 may be changed.

Figure 6:
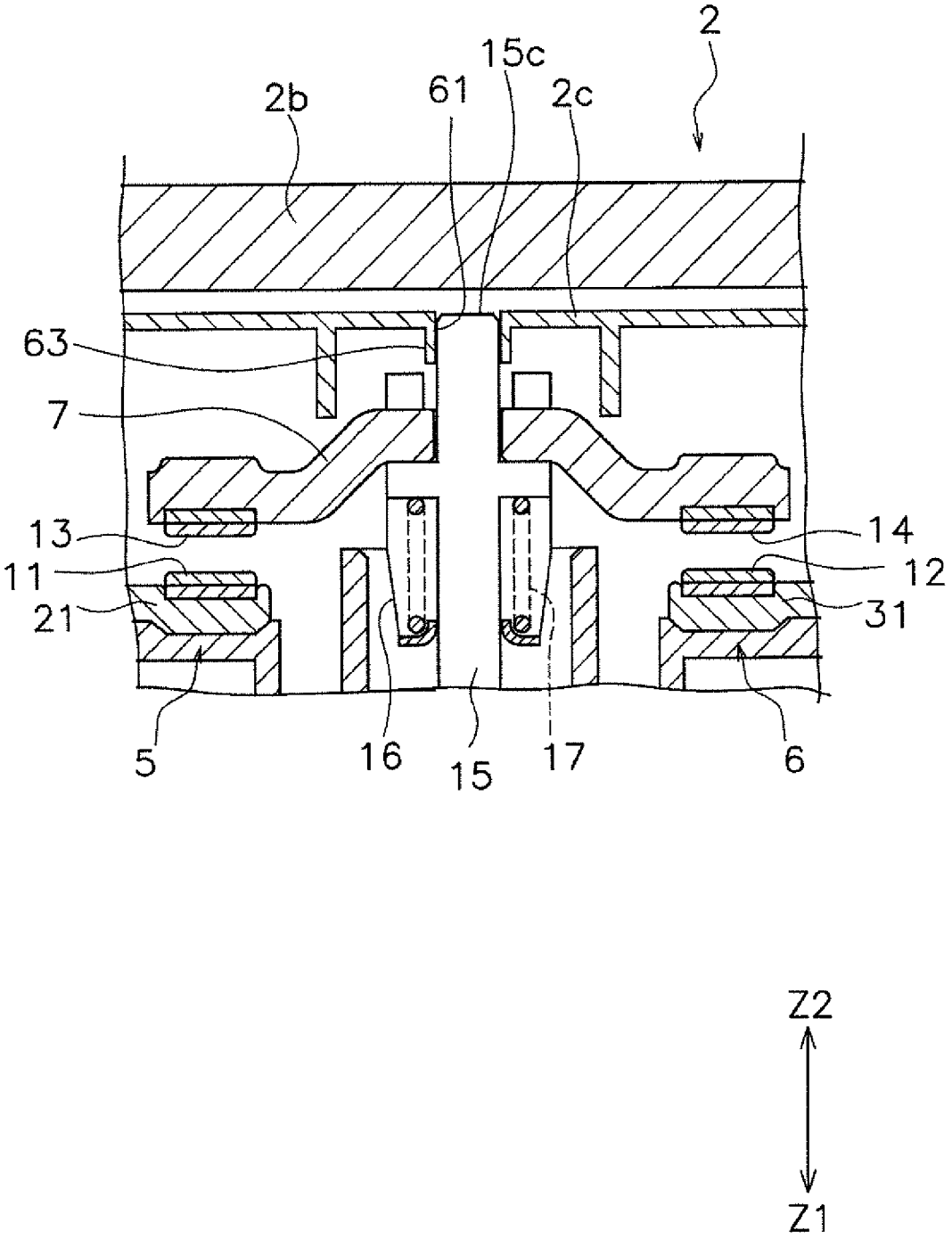
FIG. 6 is a sectional view of the periphery of the first inner cover and the second outer cover according to a first modified example.

The shape of the case 2 may be changed. For example, FIG. 6 is a sectional view illustrating the case 2 according to a first modified example. As illustrated in FIG. 6, the drive shaft 15 may be inserted into the test hole 61. Specifically, the first inner case 2*c* may include a tubular guide portion 63 extending in the axial direction of the drive shaft 15. The test hole 61 may penetrate the guide portion 63. In this instance, the test hole 61 can also serve as a guide for preventing the inclination of the drive shaft 15. In the first modified example, a portion where the guide portion 63 and the drive shaft 15 overlap is preferably longer than the stroke range of the drive shaft 15. This prevents the drive shaft 15 from coming off the guide portion 63 when the drive shaft 15 moves.

Figure 7:
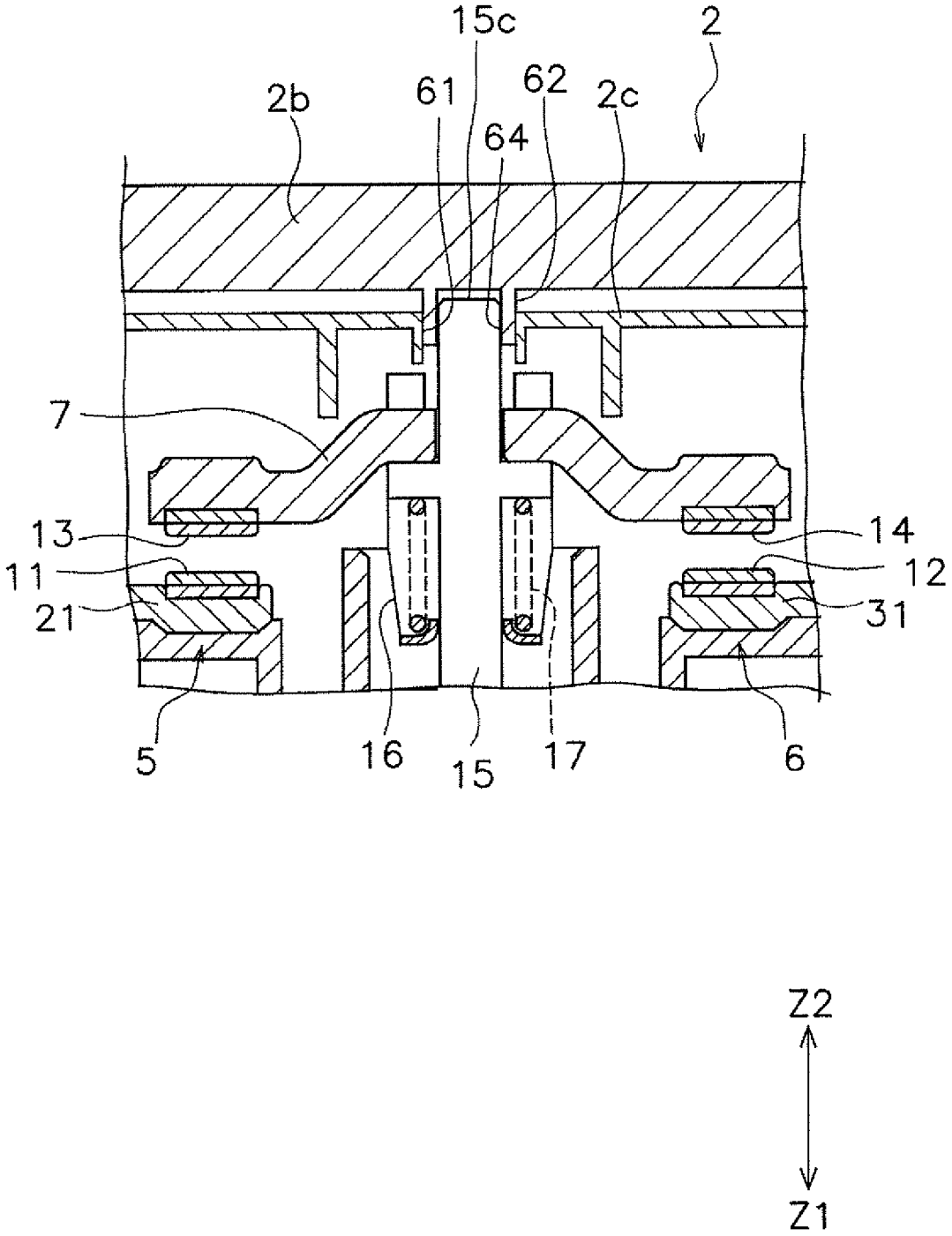
FIG. 7 is a sectional view of the periphery of the first inner cover and the second outer cover according to a second modified example.

FIG. 7 is a sectional view illustrating the case 2 according to a second modified example. As illustrated in FIG. 7, the closing portion 62 of the second outer case 2*b* may include a guide hole 64 into which the drive shaft 15 is inserted. In this instance, the closing portion 62 can also serve as a guide for preventing the inclination of the drive shaft 15.

Figure 8:
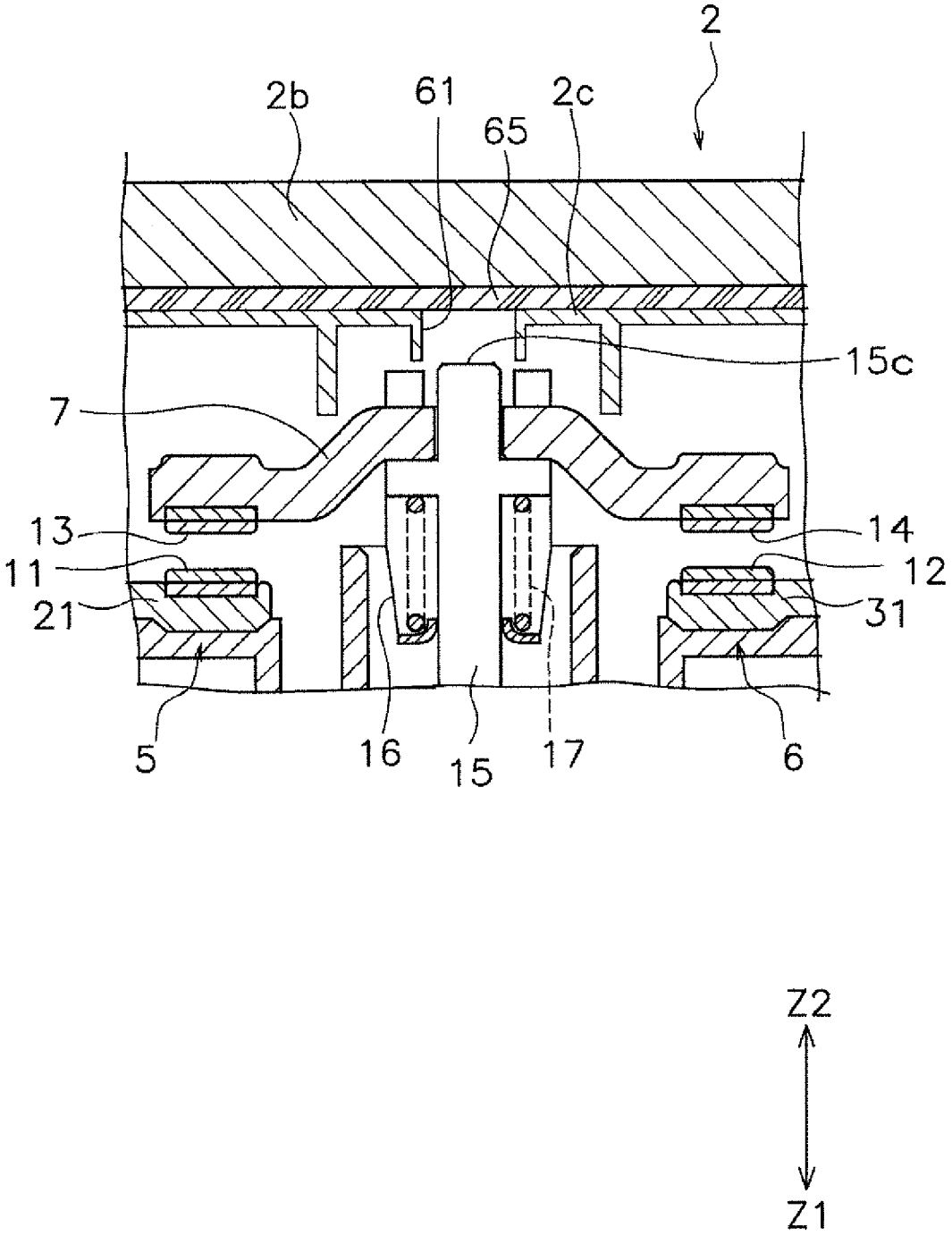
FIG. 8 is a sectional view of the periphery of the first inner cover and the second outer cover according to a third modified example.

FIG. 8 is a sectional view illustrating a case according to a third modified example. As illustrated in FIG. 8, an elastic member 65 may be disposed between the second outer case 2*b* and the first inner case 2*c*. The elastic member 65 has a sheet shape. The elastic member 65 closes the test hole 61 by sealing a gap between the second outer case 2*b* and the first inner case 2*c*. In this instance, the test hole 61 can be closed by the elastic member 65 in a normal state. When pressure inside the first inner case 2*c* and the second inner case 2*d* increases due to an arc generated at the time of turning on and off the load, the pressure can be released from the test hole 61 to the outside through the gap between the elastic member 65 and the first inner case 2*c*. Note that the elastic member 65 is not limited to the sheet shape, and may have another shape.

According to one or more embodiments of the present invention, it is possible to easily confirm characteristics in a relay while preventing occurrence of contact failure of contacts.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A relay comprising:

a first fixed contact;

a second fixed contact;

a movable touch piece including:

a first movable contact that is disposed facing the first fixed contact, and a second movable contact that is disposed facing the second fixed contact, the movable touch piece being disposed so as to be movable in a contact direction in which the first movable contact and the second movable contact come into contact with the first fixed contact and the second fixed contact and a separation direction in which the first movable contact and the second movable contact separate from the first fixed contact and the second fixed contact;

a drive device disposed in the contact direction with respect to the movable touch piece and configured to generate a driving force for moving the movable touch piece;

a drive shaft extending in a movement direction of the movable touch piece and including an end portion protruding in the separation direction from the movable touch piece and configured to transmit the driving force to the movable touch piece; and a first case configured to accommodate the first fixed contact, the second fixed contact, and the movable touch piece, wherein the first case includes a test hole that is disposed at a position facing an end portion of the drive shaft in the separation direction and penetrates completely through the first case.

2. The relay according to claim 1, further comprising:

a spring configured to urge the movable touch piece in the separation direction.

3. The relay according to claim 1, further comprising:

a second case configured to cover the first case.

4. The relay according to claim 3, wherein the second case includes a closing portion configured to close the test hole.

5. The relay according to claim 4, wherein the closing portion is a protrusion protruding from an inner surface of the second case.

6. The relay according to claim 5, wherein the protrusion includes a guide hole into which the drive shaft is inserted.

7. The relay according to claim 3, further comprising:

an elastic member disposed between the second case and the first case and configured to close the test hole.

8. The relay according to claim 7, wherein the elastic member has a sheet shape.

9. The relay according to claim 1, wherein the drive shaft is inserted into the test hole.

10. The relay according to claim 9, wherein the first case includes a guide portion having a tubular shape and extending in an axial direction of the drive shaft, and wherein the test hole penetrates the guide portion.

11. The relay according to claim 2, further comprising: a second case configured to cover the first case.

12. The relay according to claim 2, wherein the drive shaft is inserted into the test hole.

13. The relay according to claim 3, wherein the drive shaft is inserted into the test hole.

14. The relay according to claim 4, wherein the drive shaft is inserted into the test hole.

15. The relay according to claim 5, wherein the drive shaft is inserted into the test hole.

16. The relay according to claim 6, wherein the drive shaft is inserted into the test hole.

17. The relay according to claim 7, wherein the drive shaft is inserted into the test hole.

18. The relay according to claim 8, wherein the drive shaft is inserted into the test hole.

* * * * *